US012534884B2

(12) United States Patent
Brockman et al.

(10) Patent No.: US 12,534,884 B2
(45) Date of Patent: Jan. 27, 2026

(54) WORKSITE MANAGEMENT SYSTEM AND METHOD FOR A MOBILE MACHINE

(71) Applicant: Caterpillar Paving Products Inc., Brooklyn Park, MN (US)

(72) Inventors: Elizabeth R. K. Brockman, Charlotte, NC (US); Nicholas A. Oetken, Brooklyn Park, MN (US); David E. Gerding, Maple Grove, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 207 days.

(21) Appl. No.: 18/455,241

(22) Filed: Aug. 24, 2023

(65) Prior Publication Data

US 2025/0067025 A1 Feb. 27, 2025

(51) Int. Cl.
*E02F 9/26* (2006.01)
*E02F 9/20* (2006.01)

(52) U.S. Cl.
CPC ..... *E02F 9/262* (2013.01); *E02F 9/205* (2013.01)

(58) Field of Classification Search
CPC ..... E02F 9/262; E02F 9/205; E02F 9/2045; E01C 19/004; B60W 30/095; B60W 2300/12; B60W 2300/15
See application file for complete search history.

(56) References Cited

U.S. PATENT DOCUMENTS

| | | | | |
|---|---|---|---|---|
| 6,085,130 | A | 7/2000 | Brandt et al. | |
| 7,731,450 | B2 | 6/2010 | Congdon et al. | |
| 8,639,420 | B2 | 1/2014 | Corcoran et al. | |
| 10,315,655 | B2 | 6/2019 | Blank et al. | |
| 2007/0129869 | A1 | 6/2007 | Gudat et al. | |
| 2007/0239338 | A1 | 10/2007 | Potts et al. | |
| 2012/0173090 | A1 | 7/2012 | Corcoran et al. | |
| 2014/0348587 | A1* | 11/2014 | Corcoran | E01C 19/23 404/84.05 |
| 2018/0179719 | A1 | 6/2018 | Wisley et al. | |
| 2019/0073762 | A1* | 3/2019 | Kean | G06T 7/62 |
| 2021/0149391 | A1* | 5/2021 | Ready-Campbell | E02F 9/225 |
| 2024/0060262 | A1* | 2/2024 | Jancek | E02D 3/026 |

* cited by examiner

*Primary Examiner* — Russell Frejd

(57) ABSTRACT

A worksite management system directs one or more mobile machines to enhance the compaction of the terrain surface about a worksite. One or more local topography detectors that may be located on a non-compactor mobile machine measures the state of compaction of the local topography proximate to the mobile machine. An electronic controller that may be onboard the mobile machine detects if the detected state of compaction corresponds to a first topography area associated with a greater state of compaction and, if so, directs the mobile machine to a second topography area associated with a lesser state of compaction.

20 Claims, 4 Drawing Sheets

WORKSITE MANAGEMENT SYSTEM AND METHOD FOR A MOBILE MACHINE

TECHNICAL FIELD

This patent disclosure relates generally to managing operation of mobile machines at a worksite and, more particularly, to a managing mobile machines to enhance compaction of the terrain surface of the worksite.

BACKGROUND

Compactors are machines used to compact and compress the material deposited on the terrain surface of a worksite. For example, compactors are used to compact soil, aggregate, asphalt and the like at a worksite to improve the topography, possibly for subsequent operations. A typical design for a compactor includes a large cylindrical roller or drum of substantial weight that is rotationally attached to a machine frame and can be rolled over the terrain surface to compress the material there under. To achieve the desired level of compaction, compactors may conduct multiple passes over the same travel path repeatedly compressing the material underneath. Compactors often are dedicated machines configured for the single task of compacting material at the worksite.

Multiple different types of mobile machines such as haul trucks, excavators, dozers, and the like are often operating about the worksite concurrently and in conjunction with compactors. Because of their mobility and substantial weight, these other mobile machines can assist in compaction of the material at the worksite. U.S. Pat. No. 8,639,420 ("the '420 patent") describes a worksite management system for managing the operation of non-compactor type mobile machines to assist in compaction of the terrain surface at a worksite. The '420 patent in particular discloses utilizing historical data about the previous locations and travel paths of the mobile machines to organize and direct the travel paths of machines presently traveling about the worksite. The '420 patent therefore increases the efficiency of worksite development. The present disclosure is similarly directed to a system and method for managing and coordinating the operation of one or more mobile machines to efficiently improve the development of a worksite.

SUMMARY

The disclosure describes, in one aspect, a mobile machine having a machine chassis supported on a plurality of propulsion devices that contact the terrain surface of a worksite. The mobile machine can include one or more local topography detectors configured to detect a detected state of compaction of the local topography associated with the terrain surface proximate the mobile machine. The mobile machine can also include an electronic controller in electronic communication with the one or more local topography detectors. The electronic controller can be programmed to detect if the detected state of compaction of the local topography corresponds to a first topography area associated with a greater state of compaction. If the electronic controller determines the local topography does correspond to the first area of greater compaction, the electronic controller can adjust the travel path of the mobile machine to direct it to a second topography area associated with a lesser degree of compaction and thereby improve the efficiency of the development of the worksite.

In another aspect, the disclosure describes a method of compacting a terrain surface of a worksite. According to the disclosed method, a mobile machine can be propelled over the terrain surface in accordance with a travel path. The method further uses one or more local topography detectors to detect the local topography of the terrain surface to determine a detected state of compaction. If the detected state of compaction of the local topography corresponds to a first topography area associated with a greater state of compaction, the method adjusts the travel path that directs the mobile machine to a second topography area associated with a lesser state of compaction.

In yet another aspect, the disclosure describes a worksite management system that includes one or more local topography detectors configured to detect a state of compaction of a local topography of a terrain surface proximate to a non-compactor mobile machine. The worksite management system includes an electronic controller in electronic communication with the one or more local topography detectors and that is programmed to detect if the detected state of compaction of the local topography corresponds to a first topography area having a greater state of compaction. If the detected state of compaction corresponds to the first topography area, the electronic controller is further programmed to adjust a travel path to direct the mobile machine to a second topography area having a lesser state of compaction.

DETAILED DESCRIPTION

Figure 1:
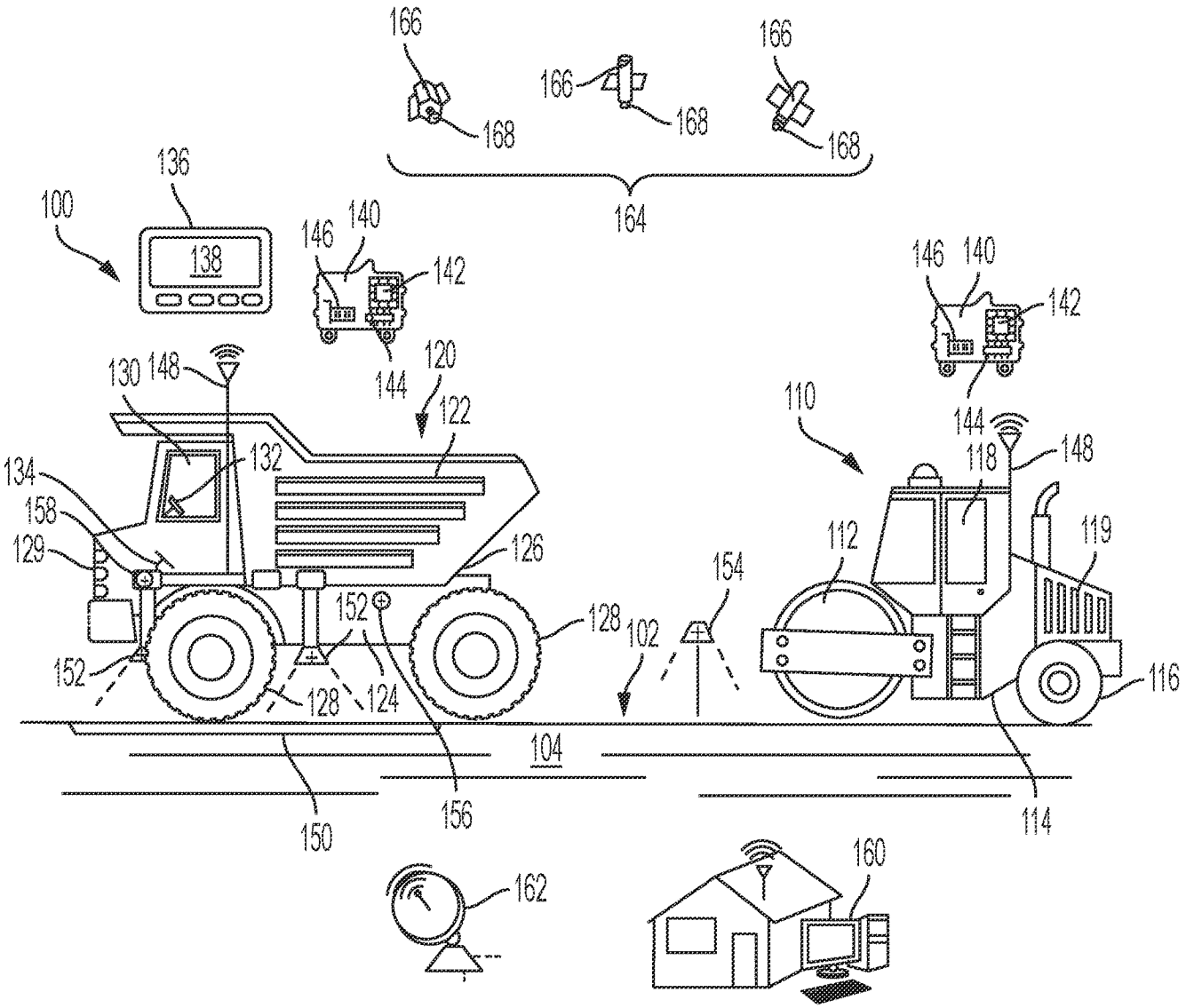
FIG. 1 is a schematic illustration of a worksite with a compactor and a non-compactor mobile machine operating thereat and operatively associated with a worksite management system configured to enhance compaction of the terrain surface of the worksite.

Now referring to the drawings, wherein whenever possible like reference numbers will refer to like elements, there is illustrated in FIG. 1 a worksite 100 at which a plurality of mobile machines may perform operations and tasks associated with the worksite. The worksite may be a construction site at which structures such as buildings or roadways are being constructed. However, aspects of the disclosure may be applicable to other types of worksites 100 such as mines or quarries for the extraction of material, agricultural sites, and the like. The worksite 100 can be associated with a terrain surface 102 that may have various contours, grades, and/or elevations as described more fully herein. The terrain surface 102 may be located over and on top of a terrain substrate 104, which may be comprised of various layers or strata of rocks or sediment. Typically, the density of material at the worksite 100 increases from the terrain surface 102 through deeper layers of the terrain substrate 104.

The fleet of mobile machines may be maintained by a single fleet operator. However, the plurality of mobile machines may be maintained and operated under the authority of different fleet operators. Accordingly, coordination and communication between the plurality of mobile machines may be detrimentally impacted.

The plurality of mobile machines are configured to travel over the terrain surface 102 while performing operations and tasks at the worksite 100. An example of a mobile machine may be a compactor 110 that is used to reduce the elevation of the terrain surface 102 through compaction by moving over the worksite 100. In particular, the compactor 110 can compress the soil, aggregate, asphalt or other material disposed on the terrain surface thereby reducing its volume. Compaction of the terrain surface 102 can facilitate its use in subsequent operations, for example, serving as a foundation for construction of structures if the worksite 100 is a construction site.

To compact the terrain surface 102 and possibly the terrain substrate 104 underneath, the compactor 110 can include a compaction roller 112 that is attached to a machine frame or compactor chassis 114 that is supported on the terrain surface 102 by one or more traction/propulsion devices 116. Examples of traction/propulsion devices 116 include wheels and continuous tracks that can translate with respect to the terrain surface 102 as the compactor 110 traverses and moves over the worksite 100.

The compaction roller 112 can be shaped as a large diameter cylinder that is rotatable with respect to the compactor chassis 114 and can be weighted with a ballast or additional weight to improve compaction. To accommodate an operator, the compactor 110 can also include an onboard operator cab 118 disposed on the compactor chassis 114 in which various operator controls are located to facilitate steering, adjusting direction of travel, and other operations of the compactor. Alternatively, the compactor 110 could be controlled by a remote operator, or operate autonomously. To power the compactor 110, including by providing motive power to the traction/propulsion devices 116, a power plant 119 such as an internal combustion engine, a hybrid internal combustion/electric drive system, or an electric motor can also be disposed on the compactor chassis 114.

Another example of a mobile machine operating at the worksite 100 may be a non-compactor mobile machine 120. As used herein, "non-compactor mobile machine" refers to any mobile machine not designed primarily or exclusively for the purpose of compacting a surface. Examples of non-compactor mobile machines include, but are not limited to, hauling machines, earthmoving machines, excavators, and loaders. In the particular embodiment of FIG. 1, the non-compactor mobile machine 120 can be a haul truck that includes an open-box haul body 122 that accommodates material and that is pivotally connected toward the rear of a machine chassis 124 by a hinge 126. The haul body 122 can be tilted with respect to the machine chassis 124 to deposit the material onto the terrain surface 102 of the worksite 104.

To support the machine chassis 124 over the terrain surface 102, the non-compactor mobile machine 120 can include one or more traction/propulsion devices 128 like wheels as illustrated or, in other embodiments, continuous tracks or the like. The traction/propulsion devices 128 can translate with respect to the terrain surface 104 to propel the non-compactor mobile machine 120 about the worksite 100. To power the traction/propulsion devices 128 and other powered components thereon, the non-compactor mobile machine 120 can also include a machine power plant 129 like an internal combustion engine, a hybrid internal combustion/electric drive system, or an electric motor.

In accordance with various aspects of the disclosure, the non-compactor mobile machine 120 may be configured for fully autonomous, semiautonomous, or manual operation. In fully autonomous operation, the non-compactor machine is operated according to a predetermined work plan without the assistance of a human operator, while in semiautonomous operation, a human operator who may be present on the machine or may be at a remote location and may be responsible for directing the machine to perform certain tasks which may be assisted with guidance or partial control from a control system operatively associated with the non-compactor mobile machine 120. In manual operation, the operator is generally responsible for directing all tasks performed by the machine.

To accommodate an operator when configured for semi-autonomous or manual operation, the non-compactor mobile machine 120 can include an onboard operator cab 130 disposed on the machine chassis 124. The operator cab 130 can include various controls and the input/output devices to direct operation of the non-compactor mobile machine 120. For example, the input/output devices can include a steering control system 132 which may comprise a steering wheel or joystick to adjust the direction of travel over the terrain surface 102. Other examples of input/output devices can include speed controls 134 such as accelerators or brakes, direction control devices to change between forward, reverse and neutral, and the like.

In addition, to interface with the operator, the input/output controls can include an operator interface display 136, also referred to as a human-machine interface ("HMI"). The operator interface display 136 can be an output device to visually present information to a human operator regarding operation of the non-compactor mobile machine 120. The operator interface display 136 can be a liquid crystal display ("LCD") 138 capable of presenting numerical values, text descriptors, graphs, charts and the like regarding operation. The operator interface display 136 may have capacities such as a touchscreen to receive input from a human operator, although in other embodiments, other interface devices may be included such as dials, knobs, switches, keypads, keyboards, mice, printers, etc.

To facilitate operation of the mobile machines, each of the mobile machines, including for example the compactor 110 and the non-compactor mobile machine 120, can be operatively associated with an electronic controller 140, which may also be referred to as an electronic control module ("ECM") electronic control unit ("ECU"), or just a controller. The electronic controller 140 can be a programmable computing device and can include one or more microprocessors 142 for executing software instructions and processing computer readable data. Examples of suitable microprocessors include programmable logic devices such as field programmable gate arrays ("FPGA"), dedicated or customized logic devices such as application specific integrated circuits ("ASIC"), gate arrays, a complex programmable logic device, or any other suitable type of circuitry or microchip. Although illustrated as a single component, in other embodiments, the functionality of the electronic controller 140 may be distributed among a plurality of separate components. In addition, the electronic controller 140 may be located onboard the mobile machine although in other embodiments some or all of the functionality may occur off board or remote from the mobile machine.

To store application software and data, the electronic controller 140 can include a non-transitory computer readable and/or writeable data memory 144, for example, read only memory ("ROM"), random access memory ("RAM"), EPROM memory, flash memory, or another more permanent storage medium like magnetic or optical storage. To interface and network with other operational systems, the electronic controller 140 can include an input/output interface 146 to electronically send and receive non-transitory data and information. The input/output interface 146 can be physically embodied as data ports, serial ports, parallel ports, USB ports, jacks, and the like to communicate via conductive wires, cables, optical fibers, or other communicative bus systems. To communicate with other operational system, the electronic controller 140 can utilize any suitable forms of communication protocol for data communication including sending and receiving digital or analog signals synchronously, asynchronously, or elsewise.

To interface with the operator, the electronic controller 140 can communicate with the operator interface display 136. The electronic controller 140 can exchange data and commands with the operator through the operator interface display 136. In an embodiment, to communicate with remote systems and devices, such as may be located on other mobile machines, the electrical controller 140 can be operatively associated with a transceiver 148 located on the mobile machines that is able to transmit and receive communication signals using wireless protocols such as radio, Wi-Fi, Bluetooth, or cellular communications. In an embodiment, the transceiver 148 can be an antenna that can convert signals and data between radio waves propagating through space and electrical currents that can be transferred through conductors and processed by the electronic controller 140.

To enhance compaction of the terrain surface 102 about the worksite 100, the electronic controller 140 can be an operative part of a worksite management system 150. The worksite management system 150 may be configured to manage operation of the mobile machines related to the state of compaction of the terrain surface 102 and possibly the terrain subsurface 104 underneath. To do so, worksite-management system 150 may perform a variety of tasks, including receiving information related to the state of compaction of the terrain surface 102, analyzing such information, and executing one or more output functions that facilitate managing operation of the mobile machines in a manner related to a state of compaction of the terrain surface 102. In an embodiment, the worksite management system 150 can be part of an enterprise network for monitoring and regulating the operations of the worksite 100. The worksite management system 150 may be maintained by the fleet operator of the plurality of mobile machines, may be maintained by any of the fleet operators of the mobile machines that are not part of the same fleet, or may be maintained by an application service provider (ASP) or through independent contractors.

To detect information about the state of compaction of the terrain surface 102, the worksite management system 150 can be operatively associated with a plurality of terrain sensors. In an embodiment, one or more of the terrain sensors may be located onboard the mobile machines and can be configured to sense or measure a physical characteristic associated with the local topography proximate to the mobile machine. The terrain sensors located onboard the mobile machines can be operatively associated with the electronic controller 140 that can process and analyze information obtained by the terrain sensors. The electronic controllers 140 can also communicate the information obtained by the one or more terrain sensors onboard the non-compactor mobile machine about the physical characteristics of the local topography with other operational systems via the transceivers 148.

For example, there can be located on the non-compactor mobile machine 120 one or more local topography detectors 152. The local topography detectors 152 can be fixedly attached to the machine chassis and can be directed toward the terrain surface 102 to directly obtain information about the physical characteristics of the local topography proximate the non-compactor mobile machine. In an embodiment, the physical characteristics detected by the local topography detectors include the state of compaction of the local topography.

For example, in an embodiment, the local topography detectors 152 can operate on spatial measurement principles wherein, the local topography detectors 152 can sense or detect the vertical distance between the location of the local topography detector on the machine chassis 124 and the terrain surface 102. For example, the local topography detector 152 can be a rangefinder used to measure the distance to a remote location. Examples of rangefinders include LIDAR ("laser imaging, detection, and ranging") systems in which a pulse of light is emitted toward and reflected back from the terrain surface 102. The time taken for the pulse to return can be converted to distance based on the known speed of light. Similar examples of rangefinders include acoustic sensors in which sound waves are emitted and reflected back from the terrain surface. RADAR is another suitable example of a rangefinder using the elapsed time of travel of radio waves between the local topography detector 152 and the terrain surface 102.

In other examples, the local topography detectors 152 can use optics to determine the spatial vertical distance between the local topography detector and the terrain surface 102. For example, the local topography detector 152 may be a smart camera capable of analyzing the captured image to determine the distance to the terrain surface 102, for example by adjusting the focal point until the terrain surface matches an expected or recognizable image. Similarly, a stereo camera can use two or more lenses to produce a three-dimensional image that can be analyzed to determine depth or vertical distance to the terrain surface. Structured light systems are another suitable type of local topography detector 152 in which a predetermined pattern of light from multiple sources is projected toward the terrain surface 102. Depending upon the distance between the light sources and the terrain surface, the predetermined pattern may become distorted to different degrees, and the distortion can be analyzed to determine the vertical distance.

In other embodiments, the local topography detector 152 can operate on other principles such as image pattern detection or color recognition, i.e. colorimetry. For example, the state of compaction of the terrain surface 102 may be determined from the visually perceptible pattern, colorization, or shading of the terrain surface. The local topography detector 152 can be an image sensor or light meter that captures and analyzes an image of the terrain surface to recognize patterns or colors within the image. The state of compaction of the local topography captured within the image can be associated with particular or distinguishable patterns or colors. For example, a greater degree of compaction may be associated with denser or darker patterns or colors.

In another embodiment, the local topography detector 152 may be in direct physical contact with the terrain surface 102 to detect the state of compaction of the local topography. For example, the local topography detector 152 can be a deflection sensor that includes one or more rods extend from the machine chassis 124 of the non-compactor mobile machine 120 to the terrain surface 102 and which may penetrate a determined distance into the terrain surface. As the non-compactor mobile machine 120 moves over the terrain surface 102, the rod will deflect due to resistance to movement of the rod through the material of the terrain surface. The deflection will be proportional to the state of compaction, and thus the density, of the material on the terrain surface 102 that can be analyzed to determine the state of compaction.

In addition to the local topography detectors 152 that can be located onboard the non-compactor mobile machine 120, other terrain sensors associated with the worksite management system 150 can include remote topography detectors 154 that are located off board and remote from the non-compactor mobile machine 120. The remote topography detector 154 can use any of the foregoing technologies such as a rangefinder or pattern recognition to sense the state of compaction of the terrain surface remote from the location of the non-compactor mobile machine 120, i.e. the remote topography. The remote topography detectors 154 can also measure other physical characteristics of the remote topography such as moisture content of the soil that can be analyzed for information relevant to the state of compaction of the remote topography.

The worksite management system 150 can also be associated with additional operational sensors to monitor and measure operational aspects of the non-compactor mobile machine 120 (only one remote topography detector 154 is shown). For example, to sense the payload or gross weight of the non-compactor mobile machine 120, a payload sensor 156 can be disposed on the machine chassis 124. In the embodiment where the non-compactor mobile machine 120 is a haul truck, the material added to the haul body 122 will increase the weight of the non-compactor mobile machine that can be sensed or measured by the payload sensor 156. The data memory 144 of the electronic controller 140 can store the empty weight or tare weight of the non-compactor mobile machine 120, which can be added to the additional weight measured by the payload sensor 156 to determine the overall or gross weight of the non-compactor mobile machine. As described below, the weight or payload of the non-compactor mobile machine 120 may be substantial and may aid or assist in enhancing the state of compaction of the worksite 100.

Another example of an operational sensor can be a speedometer, velocity sensor, or accelerometer 158 that makes measurements regarding the velocity, acceleration, or motion of the non-compactor mobile machine 120. Other examples of operational sensors can be directional meter that measure the direction of travel of the non-compactor mobile machine 120, such as forward or reverse or the steering angle.

The worksite management system 150 can also include or be operatively associated with a remote computer system, or a backend information-processing system 160, that is locate off board and remote from the mobile machines. The backend information-processing system 160 can include physical components like processing devices or processors and input-output peripherals (e.g., keyboards, monitors, mice) that enables the entry and processing of information and data in computer readable form. The backend information-processing system 160 may also include data storage capabilities to store the software instructions and data in the form of random access memory or other volatile memory, read only memory or other permanent memory, or another suitable form of memory. To communicate with the other components of the worksite management system 150 including the mobile machines operating about the worksite, the backend information-processing system 160 can be operatively associated with a telematics system 162 or the like. The telematics system 162 can communicate wirelessly with the transceivers 148 located on the mobile machines. In an embodiment, the backend information-processing system 160 can be maintained by the management of the fleet of mobile machines, or any of the various managers of different fleets of mobile machines, or may be maintained by an application service provider (ASP) or through independent contractors.

To determine the positions or locations of the mobile machines about the worksite 100, the worksite management system 150 can be operatively associated with a position determining system that may be implemented in any suitable form. For example, the position determining system can be realized as a global navigation satellite system (GNSS) or global positioning satellite (GPS) system 164. In the GNSS or GPS system 164, a plurality of manmade satellites 166 orbit about the earth at fixed or precise trajectories. Each satellite 166 includes a positioning transmitter 168 that transmits positioning signals encoding time and positioning information towards earth. By calculating, such as by triangulation, between the positioning signals received from different satellites, one can determine their instantaneous location on earth. In the present embodiment, the transceivers 148 on the land based mobile machines can be configured to also receive the positioning signals from the positioning transmitters 168. The GPS system 164 can also communicate with the telematics system 162 associated with the backend system 160.

INDUSTRIAL APPLICABILITY

Figure 2:
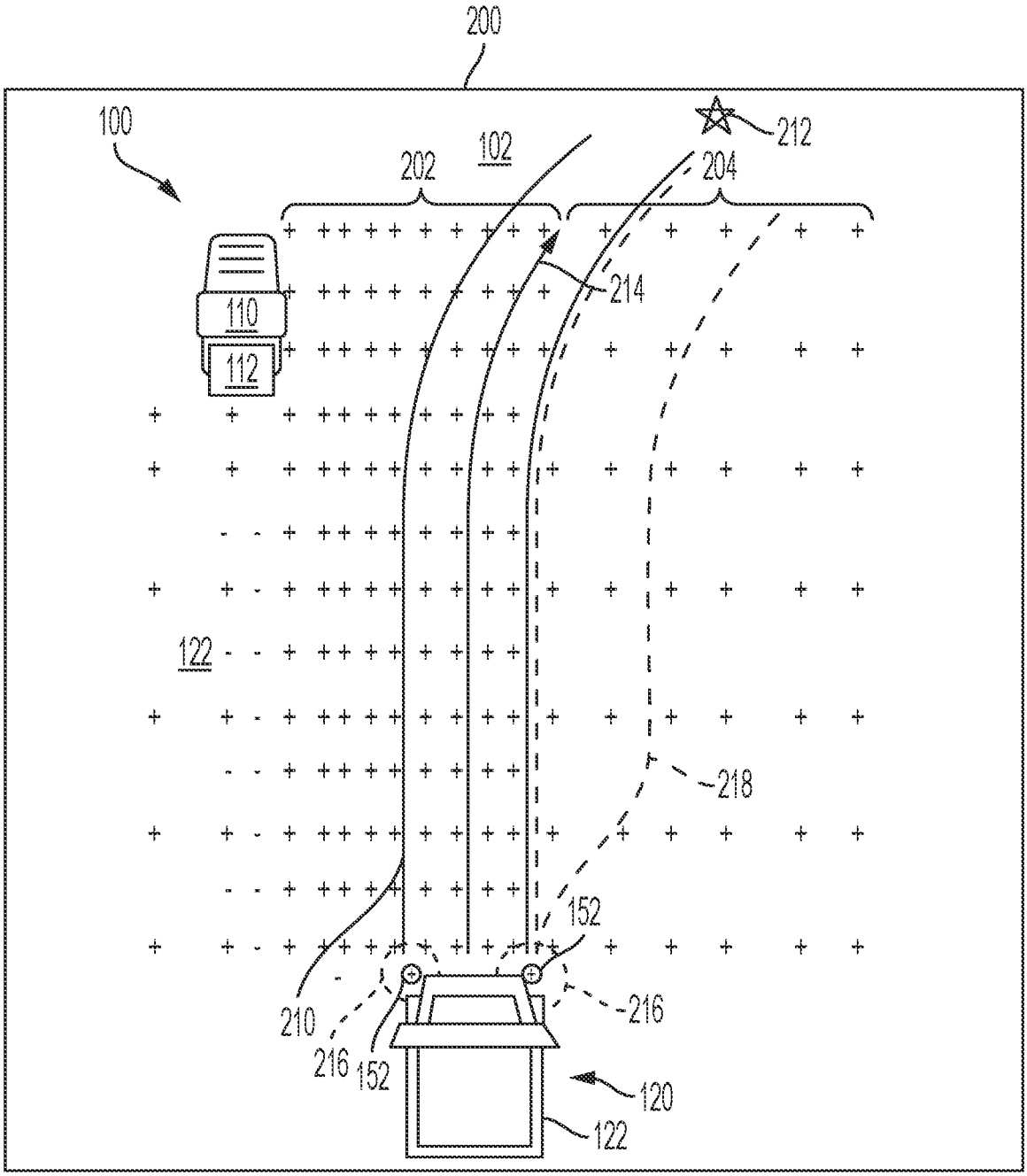
FIG. 2 illustrates adjustments to the planned travel path for the mobile machine as adjusted based on a detected state of compaction of the local topography associated with the terrain surface.

Referring to FIG. 2, with continued reference to the prior figure, there is illustrated an example of how the worksite management system 150 can facilitate compaction of the terrain surface 102 of the worksite 100. FIG. 2 may represent a site map 200 or image of the terrain surface 102 of the worksite 100 that may include a first topography area 202, or a plurality of first topography areas 202, associated with a greater degree of compaction as indicated by the heavier shading. For example, a compactor 110 having a compacting roller 112 may have already traversed the first topography area 202 in one or more passes compacting the material disposed on the terrain surface 102 within the first topography area. The site map 200 may also include a second topography area 204, or a plurality of second topography areas, associated with a lesser degree of compaction as indicated by the lighter shading. For example, the compactor 110 may not have traversed across the second topography area 204 such that the material on the terrain surface 102 remains relatively un-compacted and loose.

The worksite management system 150 can advantageously be used with non-compactor mobile machines 120 that are configured for autonomous operation in which an operator is not present onboard the non-compactor mobile machine. The non-compactor mobile machine 120 may receive or be programmed with a planned travel path 210 over the terrain surface 102 of the worksite 100 that is configured to guide and direct the non-compactor mobile machine to a desired location or planned destination 212. In the embodiment where the non-compactor mobile machine 120 is a haul truck, the planned destination 202 can be location at the worksite 100 where the haul truck is to deliver material.

The planned travel path 210 can include instructions or directions to steer or maneuver the non-compactor mobile machine 120 along a planned travel direction 214 over the terrain surface 102 by directing it forward or reverse or turning towards a lateral side. The planned travel direction 214 can correspond to the planned travel path 210 and can account for turns or the like. The planned travel path 210 can be predetermined to assume the shortest travel path to the planned destination 212 and improve efficiency by conserving fuel and reducing travel time. In embodiments where the worksite management system 150 is associated with a backend system 160, the planned travel path 210 may generated by the backend system and transmitted to the non-compactor mobile machine 120.

The planned travel path 210, however, may direct the non-compactor mobile machine 120 to travel over the first topography area 202 associated with a greater degree of compaction of the material on the terrain surface 102 thereat. The planned travel path 210 may therefore result in over-compaction of the first topography area 202, or may at least fail to take advantage of the substantial weight of the non-compactor mobile machine 120 to aid in further compaction of other portions of the terrain surface 102.

Accordingly, in an embodiment, the worksite management system 150 can use the plurality of terrain sensors, including the local topography detectors 152 disposed on the non-compactor mobile machine 120, to sense the local topography 216 of the terrain surface 102 proximate the non-compactor mobile machine. In FIG. 2, the local topography 216 is represented as a dashed circle that is within the scope or purview of the local topography detector 152 on the non-compactor mobile machine 120. The local topography detectors 152 can use any of the foregoing technologies to sense the degree of compaction associated with the local topography 216 proximate the non-compactor mobile machine 120.

The electronic controller 140 can process the information in the form of electronic data signals received from the local topography detector 152 to assess or analyze the state of compaction associated with the local topography 216. For example, the data memory 144 of the electronic controller 140 can be pre-programmed with predetermined numerical compaction thresholds indicative that the local topography 216 has already been compacted or demonstrates a sufficient degree of compaction. In another example, the electronic controller 140 can make a comparative analysis of the detected state of compaction of the local topography with detected degrees or states of compaction associated with other topological locations about the worksite 100 previously obtained as the non-compactor mobile machine 120 travels over the terrain surface 102. The previously detected states of compaction may be referred to as historical compaction data. The comparative analysis may determine that the state of compaction associated with the local topography 216 demonstrates a variation in compaction with respect to the other topological locations and the electronic controller 140 can categorize or assign the local topography 216 to one of the first topography areas 202 of greater compaction or the second topography areas 204 of lesser compaction.

If the electronic controller 140 determines the local topography 216 is associated with the first topography area 202 of greater compaction, the worksite management system 150 via the electronic controller 140 can adjust the planned travel path of the non-compactor mobile machine 120 to enhance compaction of the worksite 100. For example, the electronic controller 104 can adjust the planned travel path 210 to direct or maneuver the non-compactor mobile machine 120 toward or into the second topography area 204 of lesser compaction. To adjust the planned travel path 210, the electronic controller 140 can generate an adjusted travel path 218 by changing the planned travel direction 214 of the non-compactor mobile machine 120. The weight of the non-compactor mobile machine 120 on its traction/propulsion devices 128 will cause compaction of the portion of the second topography area 202 there beneath.

To determine if the adjusted travel path 218 continues to correspond with the second topography area 202 associated with a lesser state of compaction, the worksite management system 150 can dynamically and continuously assess the state of compaction of the local topography 216. As used herein, the term "dynamic" refers to the responsiveness of the worksite management system to actual objects and conditions about the worksite via the local topography detectors. For example, using the local topography detectors 152 on the non-compactor mobile machine 120, the associated electronic controller 140 can continue to assess the state of compaction of the local topography 216 as the non-compactor mobile machine 120 travels over the terrain surface 102. Continuously comparing the detected state of compaction with a compaction threshold or with previously obtained historical compaction data, the electronic controller 140 can dynamically determine whether the local topography 216 corresponds with either the first topography area 202 of greater compaction or the second topography area 204 of lesser compaction. The worksite management system 15 via the electronic controller 140 can make another or further adjustments to the travel path of the non-compactor mobile machine 120 if desirable. Accordingly, the worksite management system 150 is responsive to the contemporaneous, empirically observed states of compaction of the local topography 216 of the terrain surface 102 to enhance compaction of the worksite.

Figure 3:
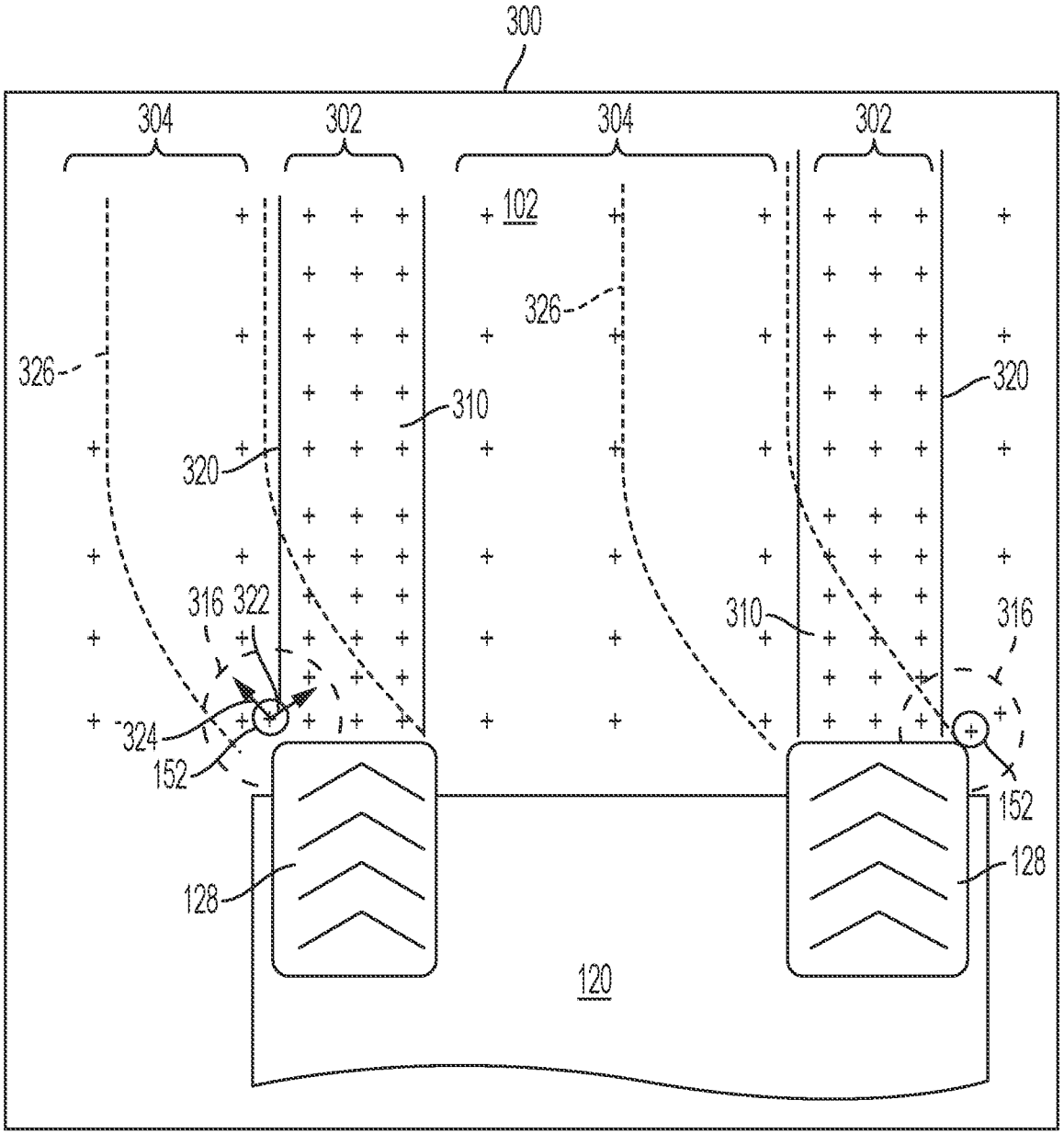
FIG. 3 illustrates in detail an embodiment of the adjustments to the travel path by shifting alignment of the traction/propulsion devices of the mobile machine.

Referring to FIG. 3, with continued reference to the prior figures, in another embodiment, the worksite management system 150 can utilize a feature referred to as edge detection to enhance compaction of the terrain surface 102 with a greater degree of precision. FIG. 3 represents a site map 300 which may include a first topography area 302 or first topography areas that are associated with greater degrees of compaction and a second topography area 304 or second topography areas that are associated with a lesser degree of compaction. In the embodiment of FIG. 3, the traction/propulsion devices 128 of the non-compactor mobile machine 120, which may be wheels, can be aligned in a travel path 310 with respect to the terrain surface 102. Similar to the embodiment of FIG. 2, if the non-compactor mobile machine 120 is autonomous, the travel path 310 can be a predetermined planned travel path that directs the non-compactor mobile machine 120 over the terrain surface 102. However, aspects of the present embodiment also may be applicable to manual or semiautonomous non-compactor mobile machines.

In the illustrated embodiment, the first topography areas 302 can correspond directly with the travel paths 310 associated with each of the traction/propulsion devices 128 of the non-compactor mobile machine 120. For example, the travel paths 310 may correspond to areas of the terrain surface 102 that have been previously compressed by a compactor traveling or passing over the worksite 100. As another example though, the non-compactor mobile machine 120 may be following another non-compactor mobile machine 120 with a plurality of traction/propulsion devices 128, or the non-compactor mobile machine 120 may be repetitively traveling along the same route such that the terrain surface 102 has become compacted by previous passes. However, the terrain surface 102 to either side of the travel paths 310 may correspond with the second topography area 304 of lesser compaction.

The worksite management system 150 via the electronic controller 140 can sense using the local topography detectors 152 onboard the non-compactor mobile machine 120 the local state of compaction to determine if the travel path 310 aligns with the first topography area 302 or with the second topography area 304. The local topography sensors 152 can be disposed forward of the traction/propulsion devices 128 to measure the local topography 316 of the terrain surface 102 prior to the non-compactor mobile machine 120 passing there over. The local topography detectors 152 can detect the state of compaction with the local topography 316 by any of the foregoing technologies. If the local topography 316 corresponds with or overlaps both the first topography area 302 and the second topography area 302, the local topography detectors 152 will detect a variation of compaction within the local topography 316. In a particular embodiment, the variation of compaction can be embodied as a compaction edge 320, which may be a one dimensional line separating the first topography area 304 and the second topography area 302. Although the compaction edges 320 in FIG. 3 are straight, in other instances the compaction edges 320 may be curved or otherwise vary. Furthermore, the compaction edges 320 may have a width resulting from the transition between the first topography area 302 and the second topography area 304.

In an embodiment, the local topography detectors 152 can operate on spatial measurement principles by measuring the vertical distances between the local topography detectors located on the non-compactor mobile machine 120 and the terrain surface 102. The local topography detectors 152 may measure a first vertical distance 322 associated with the first topography area 302 of greater compaction and a second vertical distance 324 associated with the second topography area 302 of lesser compaction. The electronic controller 140 can compare the first vertical distance 322 and the second vertical distance 324 as measured and the difference can be indicative of a variation in compaction of the local topography 316 and further indicative of a compaction edge 320. For example, the first vertical distance 322 as measured may be relatively larger because of the larger distance between the first topography area 302 of greater compaction and the terrain surface 102 and the second vertical distance 324 as measured may be relatively small because of the smaller distance between the second topography area 304 and the terrain surface 102.

If the worksite management system 150 detects a compaction edge 320, and thus detects a variation in compaction associated with the local topography 316, the worksite management system 150 can adjust the travel path 310 of the non-compactor mobile machine 120 to enhance compaction of the worksite 100. For example, the electronic controller 140 can adjust the travel paths 310 associated with the traction/propulsion devices 128 to direct or maneuver them away from the first topography areas 302 of greater compaction and toward or into the second topography area 304 of lesser compaction. The traction/propulsion devices 128 may therefore assume adjusted travel paths 322 that differ from the original travel paths 310 and that correspond to the second topography area 304 of lesser compaction. The adjusted travel paths 322 can be realized by steering or maneuvering the non-compactor mobile machine 120 toward one or the other lateral sides.

To determine if the adjusted travel paths 322 continue to correspond with the second topography areas 302 associated with a lesser state of compaction, the worksite management system 150 can dynamically and continuously assess the state of compaction of the local topologies 316. For example, using the local topography detectors 152 on the non-compactor mobile machine 120, the electronic controller 140 can continuously seek the presence of a compaction edge 320 within the local topography 316 that may be indicative of variations in the compaction of the local topography as the non-compactor mobile machine 120 travels over the terrain surface 102. If the electronic controller detects a variation in the compaction of the local topography 316, meaning the local topography 316 corresponds with or overlaps both the first topography area 302 and the second topography area 304, the worksite management system 150 via the electronic controller 140 can make another or further adjustments to the travel path 310 of the non-compactor mobile machine 120. Hence, the adjusted travel paths 318 of the traction/propulsion devices 128 are continuously and dynamically adjusted in response to the contemporaneous state of compaction of the local topography 316 as empirically measured.

Figure 4:
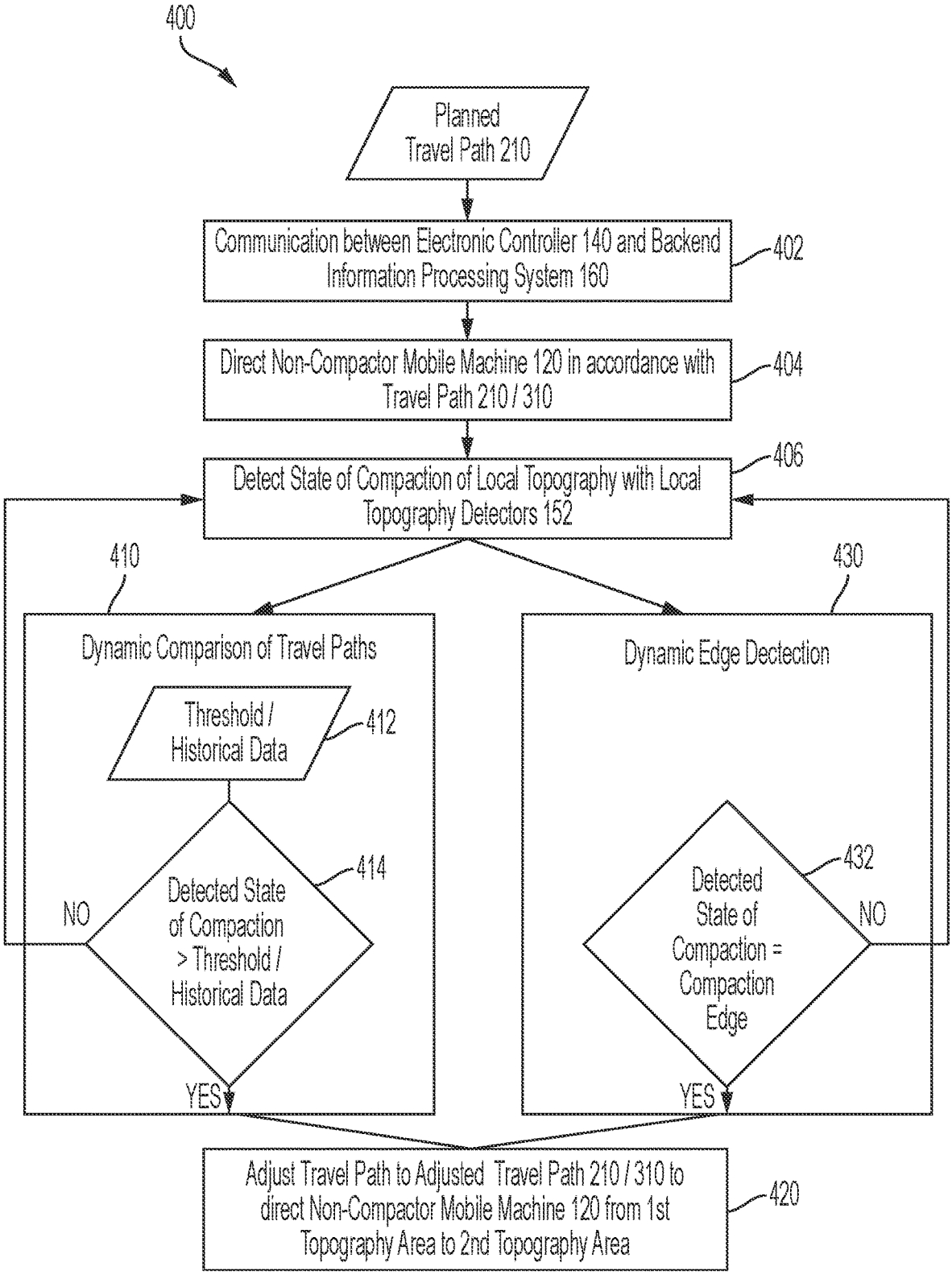
FIG. 4 is a flow diagram of a possible method for adjusting the planned travel path for the mobile machine based on the detected variation in compaction.

Referring to FIG. 4, with continued reference to the prior figures, there is illustrated an example of a flow diagram 400 of a possible sequence of steps or operations that the worksite management system 150 may conduct to enhance compaction of the terrain surface 102 about the worksite 100. The steps and processes of the flow diagram 400 may be embodied as software instructions forming a computer executable program or application written in a suitable programming code.

In an embodiment, the electronic controller 140 responsible for executing the steps depicted in the flow diagram 400 may, in a communication step 402, receive a planned travel path 210 for the non-compactor mobile machine 120. The planned travel path 210 may be comprised of a series of steering maneuvers to direct the non-compactor mobile machine 120 to a planned destination 212. The planned travel path may facilitate autonomous operation of the non-compactor mobile machine. The planned travel path may originate from the backend information-processing system 160 associated with the worksite management system 150 and may reflect considerations such as efficiency, fuel consumption, travel time, etc. In other embodiments, however, the non-compactor mobile machine may be operated in accordance with a random travel path, for example, during manual operation.

In a propulsion step 404, the non-compactor mobile machine 120 can traverse the worksite 100 in accordance with one of the planned travel path 210 or a (possibly) random travel path 310. To improve compaction about the worksite 100, the worksite management system 150 can utilize the local topography detectors 152 disposed on the machine chassis 124 to sense a state of compaction of the local topography of the terrain surface 102 proximate to the non-compactor mobile machine 120. The local topography detectors 152 may be rangefinders operating on spatial measurement principles, may be image or light sensors that utilize pattern detection or color recognition, or may be a deflection sensor physically contacting the terrain surface within the local topography. The local topography detectors 152 can detect the state of compaction of the local topography during a detection step 406. The local topography detector 152 thereby directly and empirically obtain the detected state of compaction associated with the local topography.

In a dynamic embodiment 410, the electronic controller 140 can continuously and dynamically analyze the detected state of compaction by, for example, continuously comparing the detected state of compaction of the local topography with one or more of a compaction threshold and historical compaction data 412. The compaction threshold can be a predetermined numerical value associated with a desired state of compaction for the terrain surface 102 of the worksite 100 and may be stored in the data memory 144 of electronic controller 140. The worksite management system 150 may have previously obtained the historic compaction data by measuring compaction states at other topography locations about the worksite. In a comparison step 414, the worksite management system 150 can compare and determine if the detected state of compaction exceeds or is greater than the compaction threshold or the historical compaction data 412. If the comparison step 414 determines the detected state of compaction does not exceed the compaction threshold or historical compaction data 412, the non-compactor mobile machine 120 can continue to proceed with respect to the original travel path 210, 310.

If the comparison step 414 determines the detected stats of compaction exceeds the compared values, it would indicate that the current travel path corresponds to a first topography area associated with a greater state of compaction and further compaction of the terrain surface is unnecessary. Accordingly, the worksite management system 150 can, in an adjustment step 420, adjust the travel path of the non-compactor mobile machine to an adjusted travel path 320 over a second topography area associated with a lesser state of compaction. The worksite management system 150 therefore directs the non-compactor mobile machine to assist in compaction of the worksite 100. To ensure the adjusted travel path continues to correspond to the second topography area, the worksite management system 150 can continuously and repeatedly detect the state of compaction of the local topography using the local topography detectors on the non-compactor mobile machine 120.

In another embodiment, the electronic controller 140 can conduct an edge detection routine 430. For example, the detected state of compaction of the local topography may correspond to both a first topography area associated with a greater degree or state of compaction and to a second topography area associated with a lesser degree or state of compaction. The worksite management system 150 using the electronic controller 140 can conduct a comparison step 432 that compares the first and second topography areas to detect to whether there is a compaction edge indicative of a variation in compaction of the local topography. The comparison step 432 may be based upon measured spatial distances between the local topography detectors 152 and the terrain surface 102, although in other embodiments, pattern detection, color recognition, and/or physical deflection can be used in the comparison step 432. If the comparison step 432 does not detect a compaction edge or a variation in compaction with respect to the local topography, the non-compactor mobile machine 120 can continue along the original travel path 210, 310.

If the compaction step 432 does detect a compaction edge or variation in compaction, the worksite management system 150 can proceed again to the adjustment step 420 wherein the travel path is adjusted to an adjusted travel path that directs the non-compactor mobile machine 120 toward the second topography area associated with the lesser degree of compaction. As before, to ensure that the adjusted travel path continuous to correspond with the second topography area, the worksite management system 150 can continue to detect the state of compaction associated with the local topography via the local topography sensor 152.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

The use of the terms "a" and "an" and "the" and "at least one" or the term "one or more," and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B" or one or more of A and B") is to be construed to mean one item selected from the listed items (A or B) or any combination of two or more of the listed items (A and B), unless otherwise indicated herein or clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

We claim:

1. A mobile machine, comprising:

a machine chassis, supported on a plurality of traction/propulsion devices which contact a terrain surface of a worksite, wherein the mobile machine is a non-compactor mobile machine;

one or more local topography detectors configured to:

detect a state of compaction of a local topography associated with the terrain surface proximate the mobile machine; and an electronic controller, disposed onboard the mobile machine configured to;

detect that the state of compaction corresponds to a first topography area, and adjust, based on detecting that the detected state of compaction corresponds to the first topography area, a travel path to direct the mobile machine to a second topography area, wherein the second topography area is associated with a lesser degree of compaction than the first topography area.

2. The mobile machine of claim 1, wherein the state of compaction further corresponds to the second topography area; and wherein the electronic controller is further configured to;

detect a variation in compaction of the local topography indicative of the first topography area and the second topography area, wherein the travel path is adjusted based on detecting the variation in compaction of the local topography.

3. The mobile machine of claim 2, wherein the electronic controller is further configured to:

detect a compaction edge distinguishing the first topography area and the second topography area, wherein the travel path is further adjusted based on detecting the compaction edge.

4. The mobile machine of claim 3, the first topography area is associated with a first vertical distance between the one or more local topography detectors and the terrain surface and the second topography area is associated with a second vertical distance between the one or more local topography detectors and the terrain surface.

5. The mobile machine of claim 4, wherein the electronic controller is further configured to;

compare the first vertical distance and the second vertical distance to determine the variation in compaction.

6. The mobile machine of claim 1, wherein the travel path is a planned travel path for the mobile machine.

7. The mobile machine of claim 6, wherein, to adjust the travel path, the electronic controller is configured to;

adjust from the planned travel path to an adjusted travel path to direct the mobile machine to the second topography area.

8. The mobile machine of claim 7, wherein the electronic controller is further configured to;

compare the detected state of compaction with one or more of a compaction threshold and historical compaction data, wherein the planned travel path is adjusted based on comparing the detected state of compaction.

9. The mobile machine of claim 7, wherein the electronic controller is further configured to;

receive, from a backend information-processing system, the planned travel path for the mobile machine.

10. The mobile machine of claim 1, wherein the one or more local topography detectors is a rangefinder.

11. The mobile machine of claim 10, wherein the rangefinder is one or more of a radar, a lidar, an acoustic sensor, a smart camera, a stereo camera, or a structured light system.

12. The mobile machine of claim 1, wherein the one or more local topography detectors is one or more of an image sensor or a light sensor.

13. The mobile machine of claim 1, wherein the one or more local topography detectors is a deflection sensor.

14. A method comprising:

detecting, by a controller onboard a mobile machine and when the mobile machine is traveling along a travel path, a local topography of a terrain surface using one or more local topography detectors, disposed on the mobile machine, producing a detected state of compaction, wherein the mobile machine is a non-compactor machine;

detecting, by the controller, that the detected state of compaction of the local topography corresponds to a first topography area; and adjusting, by the controller and based on detecting the detected state of compaction, the travel path to an adjusted travel path directing the mobile machine to a second topography area, wherein the second topography area is associated with a lesser degree of compaction than the first topography area.

15. The method of claim 14, further comprising:

detecting that a second detected state of compaction of the local topography corresponds to the second topography area; and detecting a compaction edge distinguishing the first topography area and the second topography area, wherein the travel path is adjusted based on detecting the compaction edge.

16. The method of claim 15, further comprising:

detecting a first vertical distance between the one or more local topography detectors and a first portion of the terrain surface, wherein the first portion of the terrain surface corresponds to the first topography area; and detecting a second vertical distance between the one or more local topography detectors and a second portion of the terrain surface, wherein the second portion of the terrain surface corresponds to the second topography area.

17. The method of claim 14, wherein detecting that the detected state of compaction corresponds to the first topography area comprises:

comparing the detected state of compaction with one or more of a compaction threshold or historical compaction data.

18. The method of claim 14, wherein the detected state of compaction of the local topography is detected using pattern detection or color recognition.

19. A worksite management system, comprising:

one or more local topography detectors configured to;

detect a state of compaction of a local topography of a terrain surface proximate to is a non-compactor mobile machine; and an electronic controller, disposed onboard the mobile machine, configured to;

detect that the detected state of compaction of the local topography corresponds to a first topography area; and adjust, based on detecting that the detected state of compaction corresponds to the first topography area, a travel path to direct the mobile machine to a second topography area, wherein the second topography area is associated with a lesser state of compaction than the first topography area.

20. The worksite management system of claim 19, wherein the one or more local topography detectors is at least one of a rangefinder, an image sensor, and a deflection sensor.

* * * * *